US006289594B1

(12) United States Patent
Wrobbel

(10) Patent No.: US 6,289,594 B1
(45) **Date of Patent: *Sep. 18, 2001**

(54) DRYWALL MARKING AND SCORING GUIDE

(76) Inventor: Randolph Wrobbel, 6811 River Pkwy., Milwaukee, WI (US) 53213

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/156,783

(22) Filed: Sep. 17, 1998

Related U.S. Application Data

(60) Provisional application No. 60/059,826, filed on Sep. 23, 1997.

(51) Int. Cl.[7] ..... B43L 13/00; B43L 7/00; B25H 7/00

(52) U.S. Cl. ..... 33/42; 33/429; 33/437; 33/474; 33/677; 33/479; 33/669

(58) Field of Search ..... 33/42, 41.1, 41.4, 33/483, 613, 429, 430, 437, 474, 479, 666, 669, 677, 476, 481, 492, 494, 41.6, 44

(56) References Cited

U.S. PATENT DOCUMENTS

| | | | | |
|---|---|---|---|---|
| D. 367,617 | * | 3/1996 | Wiegman | 33/483 |
| D. 376,988 | * | 12/1996 | Bruno | 33/483 |
| D. 399,440 | * | 10/1998 | Taylor | 33/483 |
| 844,157 | * | 2/1907 | Loughborough | 33/474 |
| 1,849,493 | * | 3/1932 | Larkin | 33/437 |
| 5,103,570 | * | 4/1992 | Nichols | 33/481 |
| 5,182,975 | * | 2/1993 | Warner | 33/481 |
| 5,309,642 | * | 5/1994 | McGinnis | 33/42 |
| 5,497,558 | * | 3/1996 | Wagner | 33/481 |
| 6,032,378 | * | 3/2000 | Null | 33/42 |
| 6,070,331 | * | 6/2000 | Dempsey | 33/42 |

* cited by examiner

*Primary Examiner*—Diego Gutierrez
*Assistant Examiner*—Yaritza Guadalupe
(74) *Attorney, Agent, or Firm*—Ryan Kromholz & Manion, S.C.

(57) ABSTRACT

A drywall marking and scoring guide tool having a generally T shape that includes a U-shaped top channel to slidably engage the edge of a drywall sheet, the top channel having a perpendicular stem extending from the channel and incorporating a plurality of guide apertures incrementally spaced along the stem's length. The guide apertures to receive a marking or scoring device so as the guide is drawn down the length of a drywall sheet the surface of the sheet is scored or marked.

5 Claims, 6 Drawing Sheets

DRYWALL MARKING AND SCORING GUIDE

Priority and benefit of earlier filing date of provisional application Ser. No. 60/059,826, filed Sep. 23, 1997, is claimed.

BACKGROUND OF THE INVENTION

The present invention relates to a tool for measuring, cutting and scoring stock planer material. More particularly, the present invention is concerned with a new and improved drywall cutting guide for quickly marking and cutting drywall sheets.

Drywall board is used extensively in the construction of interior regions of all types of public and private structures. Drywall board is generally manufactured in large sheets of 4 feet by 8 feet or larger, and is comprised of a compressed chalk-like substance laminated on each side by a thin cardboard or paper material. These drywall sheets are used as an inexpensive wall or surface cover for interior construction support structures such as wood or concrete and are generally painted or covered with wallpaper trim to fit the cosmetic needs of the particular construction.

Because of their size, and the large surface area generally being covered by drywall sheets, drywall construction requires multiple sheets to be adjoined together in an abutting manner. To accomplish the necessary multiple flush abutments between adjoining drywall sheets, a drywall worker must make repetitive cuts in the drywall that are true and straight over a long distance.

The best method of creating a straight cut in a drywall sheet is to score one side of the paper laminate and snap the drywall by bending it along that score.

Alternative cutting methods that use a circular or straight serrated saw often create a rough cut that breaks apart the compressed inner substance of the drywall creating an edge that is not suitably accurate for an abutment or a cosmetic interior trim piece. The present invention provides an uncomplicated drywall cutting guide which enables the user to measure and produce a clean, straight, horizontal cut in a drywall sheet in a single operation with a common hand-held utility knife.

SUMMARY OF THE INVENTION

The present invention is an apparatus for guiding a cutting and marking device across the surface of a of stock planar material comprising a U-shaped channel, the U-shaped channel having an upper section, a lower section, and a mid section; the upper section connected to the mid section at a substantially right angle; the lower section connected to the mid section at a substantially right angle; a stem, the stem connected to the upper section; and a plurality of guide apertures being formed in said stem section. Alternatively, the invention could be described as an apparatus for guiding a marking and scoring device across the surface of a sheet of stock planar material comprising a midsection having a first midsection edge and a second midsection edge; a bottom section having a bottom section edge, the bottom section edge connected to the first mid section edge at a substantially right angle; a stem having a stem edge, the stem edge connected to the second mid section edge at a substantially right angle; a plurality of guide apertures being formed in said stem section.

The present marking and scoring guide includes a top portion and a stem portion. The top portion forms a U-shaped channel guide which is slidably engagable within an edge of a drywall sheet to be cut. The top portion is further normal to the drywall sheet planar surface. The stem of the guide incorporates a plurality of incrementally placed guide apertures to guide a marking or cutting or scoring device such that the marking or cutting or scoring device can be drawn across the drywall sheet in a straight line parallel with the edge of the drywall where the top of the guide is engaged. The guide apertures are made up of conical apertures for receiving a marking device such as a pencil, and of similarly positioned adjacent linear slits for receiving the blade of a common utility knife or the like.

DETAILED DESCRIPTION

Figure 1:
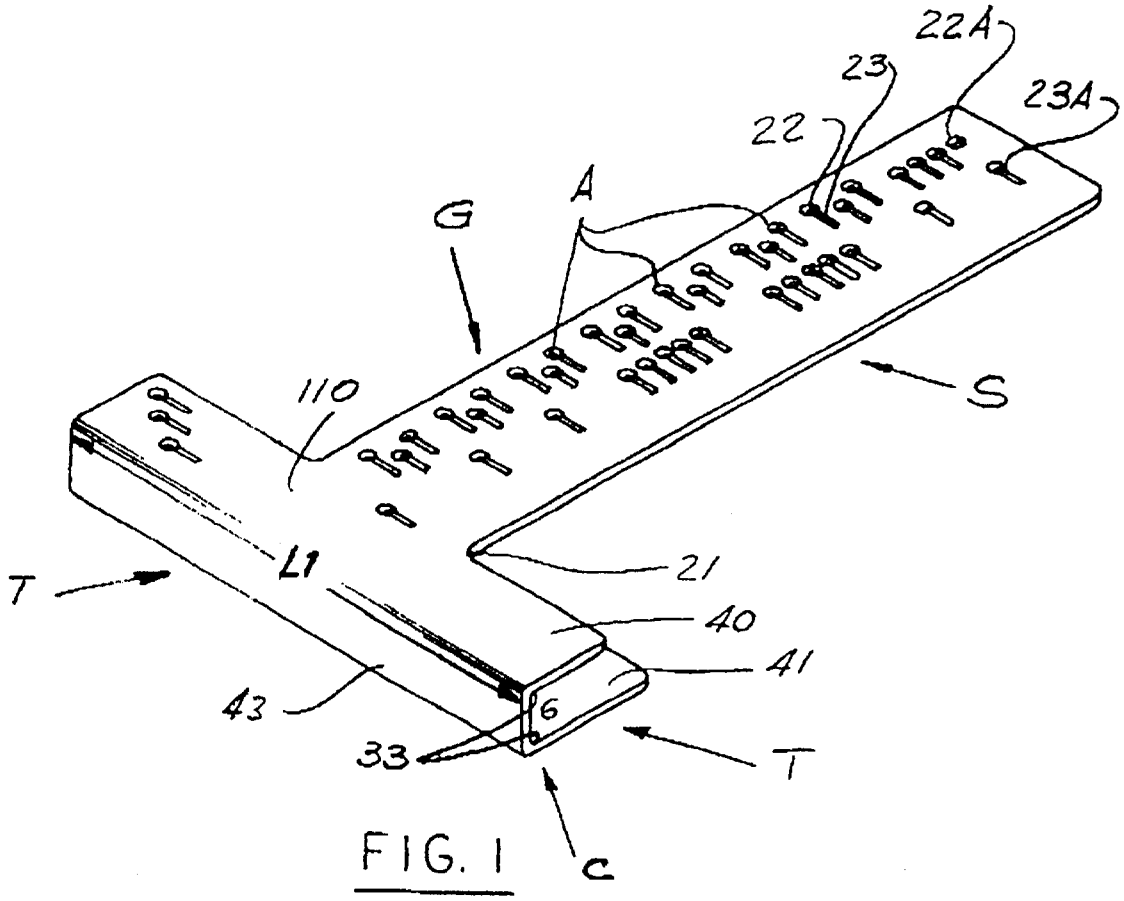
FIG. 1 is a perspective view of the marking and scoring guide showing the u-shaped top portion and the graduated guide apertures along the stem.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Referring to the drawings, wherein like referenced characters designate corresponding parts throughout the several figures, the drywall marking and scoring guide of the present invention is indicated generally by the reference character G, and comprises a sectional top portion T, a sectional stem portion S, and guide apertures A. The top portion T is formed of a generally U-shaped channel C over the length L1 of the top portion T; said U-shaped channel is comprised of an upper section 40, a lower section 41, and a midsection 42. The upper section 40 of the U-shaped channel C is connected to, and terminates in, a stem section S at position 21. In the preferred embodiment, the guide G is constructed of a single molded piece of generally flat aluminum of a uniform thickness T1. However, it is reasonable that other substantially ridged material could be used to obtain the same or similar function.

Figure 5:
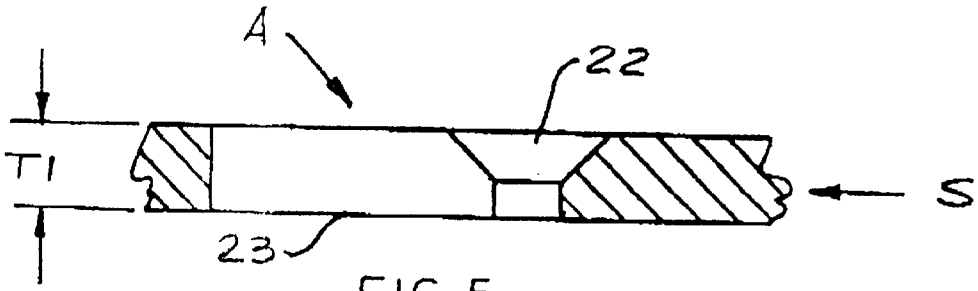
FIG. 5 is a side sectional view of the stem showing the conical and linear aperture comprising one guide aperture.
Figure 6A:
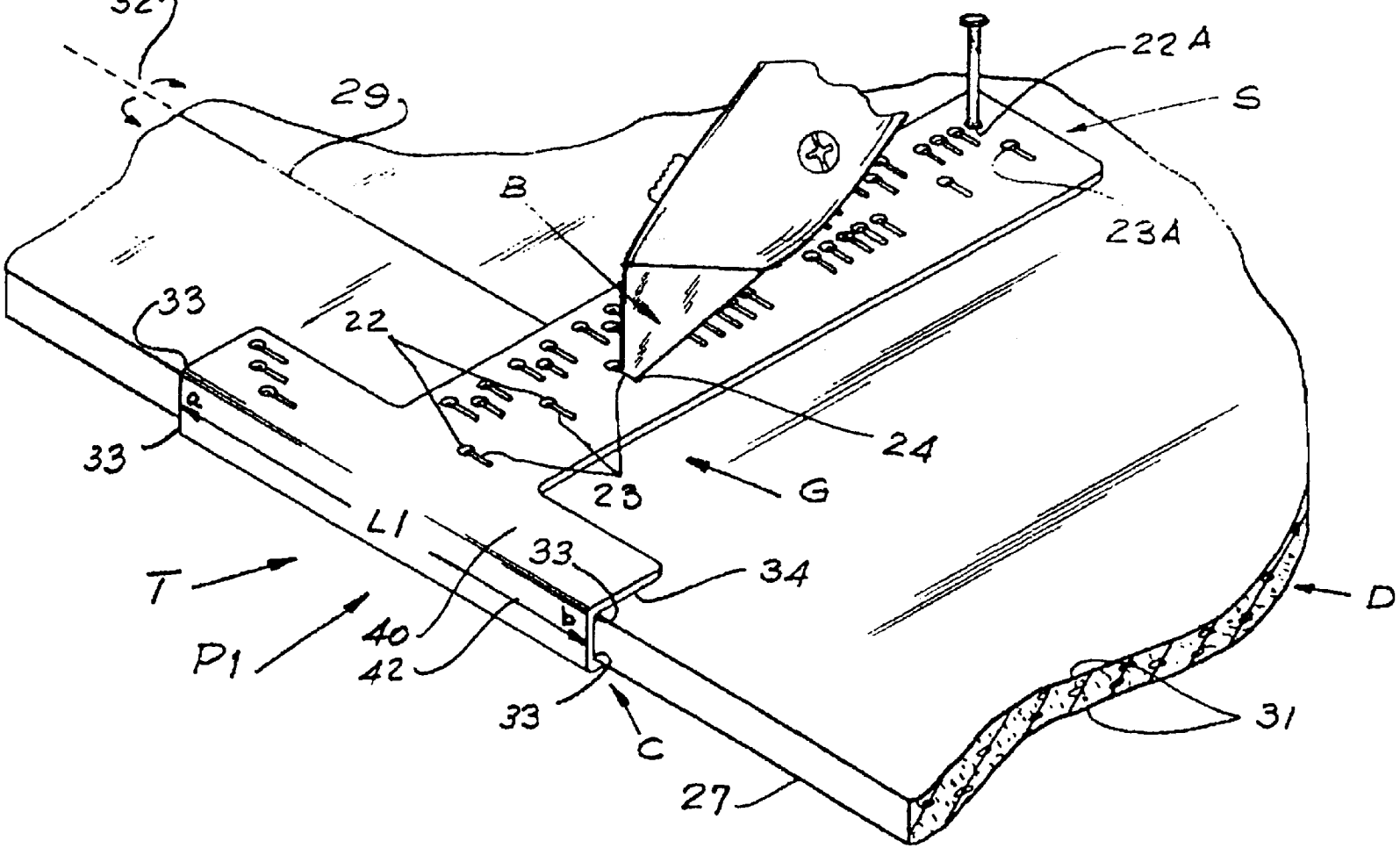
FIG. 6A is a perspective environmental view of the guide in which a guide aperture is receiving a utility blade and creating a score along the surface of a drywall sheet.
Figure 6B:
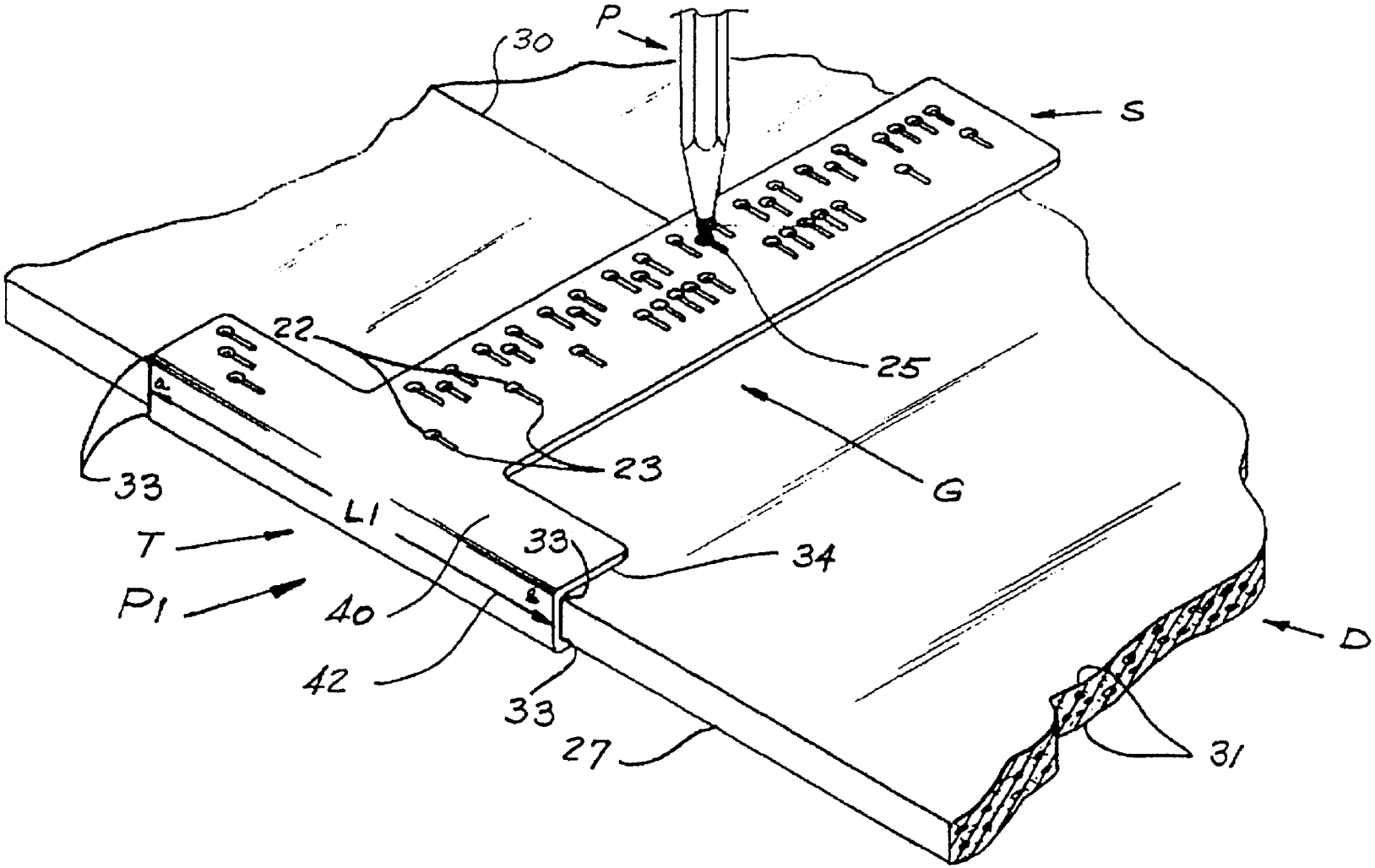
FIG. 6B is a perspective environmental view showing the guide used with a marking device creating a marked line along a drywall sheet.

Referring to FIGS. 1 and 5, along the length of the stem S are a plurality of guide apertures A comprised of a combined conical 22 and linear 23 aperture formed through the stem section S. Shown in detail in FIG. 5, the guide aperture A is comprised of a linear guide index 23 adjacent to a conical guide index 22 through the complete thickness T1 of the stem section S. Referring to FIG. 6A, a linear aperture guide 23 is used to receive a utility cutting blade B at position 24. Referring to FIG. 6B, a conical aperture 22 is used to receive a marking device P at position 25.

Figure 7:
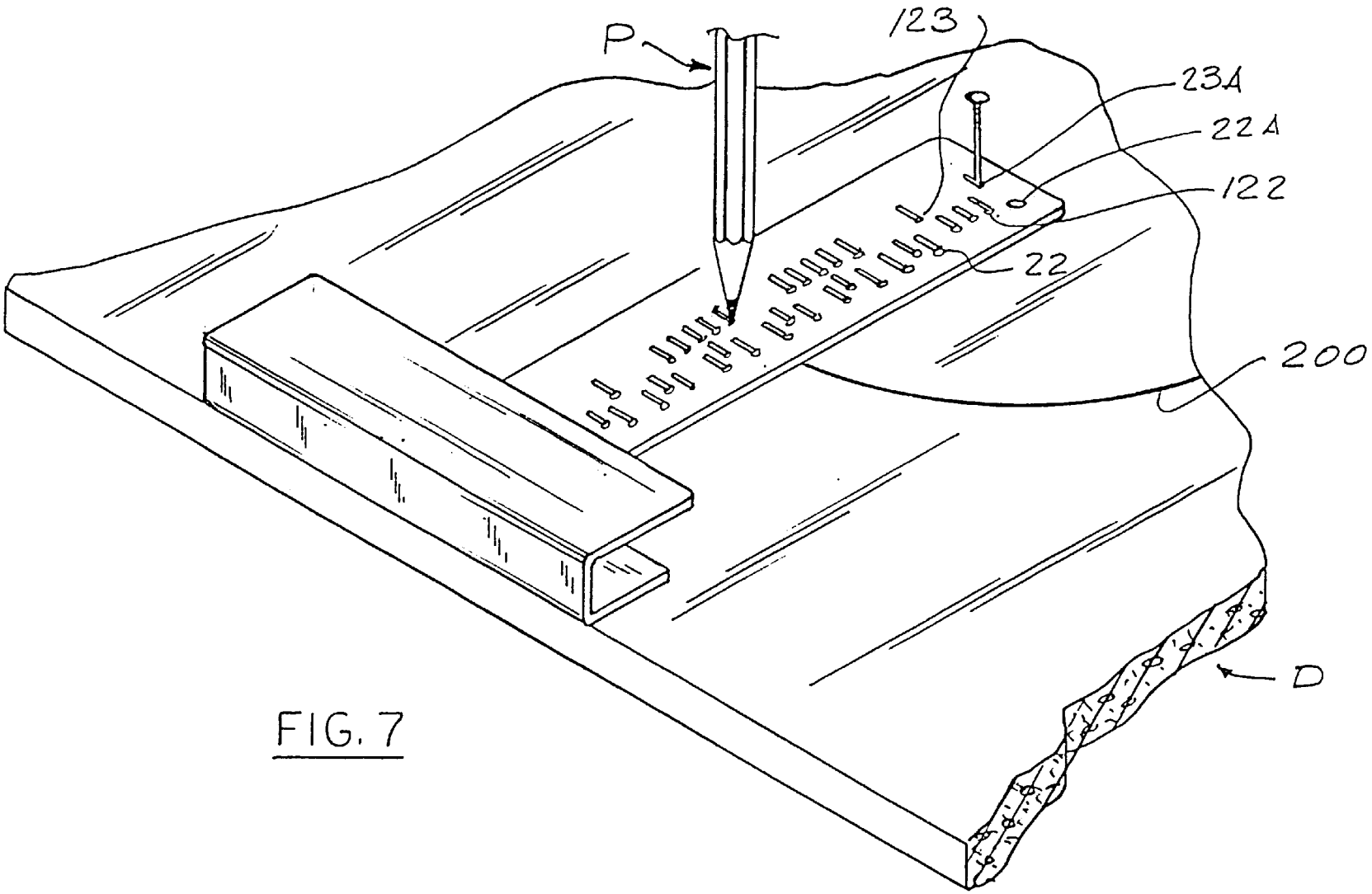
FIG. 7 is a perspective environmental view showing the guide used with a marking device to mark an arc of curvature for trimming the drywall sheet to fit an arcuate opening such as a doorway.

Referring to FIGS. 1, 2, 4 and 7 openings 22A and 23A may be seen. Opening 22A is an alignment point for series 122 of previously noted conical indexes 22 and linear apertures 23. (See FIG. 2, series 122 located to the right of dashed line X.) Opening 23A is an alignment point for series 123 of previously noted conical indexes 22 and linear apertures 23. (See FIG. 2, series 123 located to the left of dashed line X.) Openings 22A and 23A act as compass alignment points so that a craftsman may place a nail or other device through the compass alignment point 22A or 23A and a pencil or other marking instrument P may be inserted into one of the openings 22 of either series 122, if compass alignment point 22A is used, or series 123, if compass alignment point 23A is used. An arc 200 of the desired dimension may then be drawn on the drywall material (or on whatever material is being used) to mark the drywall material for cutting along the desired arc so that the drywall material may be shaped for a specific use such as the formation of an arc-shaped doorway, window, etc. This structure of the present invention enables the craftsman to draw an accurate arc without having to make more than one measurement when drawing the arc. Prior to drawing the arc, the craftsman would of course make his usual measurements for plumb, square, and center. Arc drawing using the present invention is done by laying top face 110 down against the surface of the drywall and the invention would lay on the drywall surface in the same manner as shown in FIG. 7.

Shown best in operation in FIGS. 6A and 6B, the U-shaped channel C of guide G slidably receives an edge 27 of a drywall sheet D in an abutting parallel manner. Sufficient pressure is applied by the hand of the guide user in the direction shown by arrow P1 to the top portion T of guide G toward the edge 27 of the drywall sheet D to maintain constant parallel contact between the inner surface of the U-shaped channel C with the edge 27 of the drywall sheet D. Simultaneously, a cutting device B or a marking device P is inserted into a desired linear 23 or conical 22 guide aperture A and moved in concert with the guide G as it is slid down the edge 27 of the drywall sheet D. This action guides a utility knife B or a marking device P and creates a straight score line 29 or marked line 30 parallel to the edge 27 of said drywall sheet D.

A score line 29 weakens the surface laminate 31 of the drywall sheet D and allows the sheet D to be easily bent away from the scored surface 29 as indicated by arrows 32 creating a straight break in the drywall sheet. To complete the cut in the drywall sheet D, the portions of the drywall opposite the score 29 and resulting break are then alternatively bent toward the scored 29 surface to snap the surface laminate 31 opposite the scored 29 surface.

Figure 4:
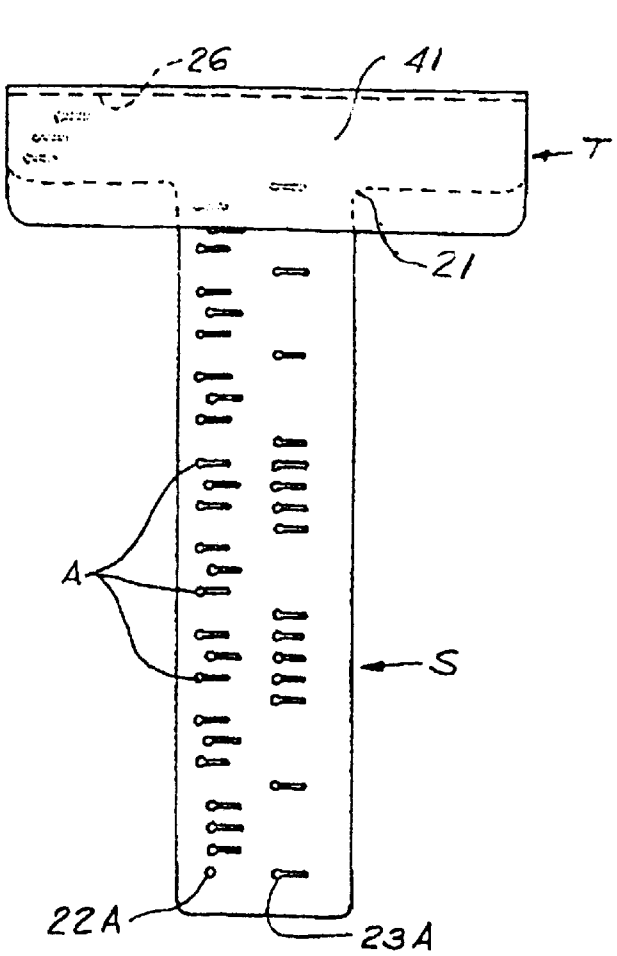
FIG. 4 is a bottom plan view of the guide.
Figure 3:
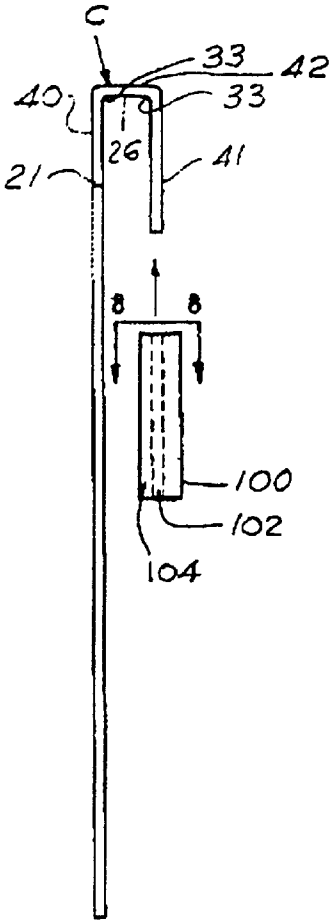
FIG. 3 is a side elevational view of the guide.
Figure 2:
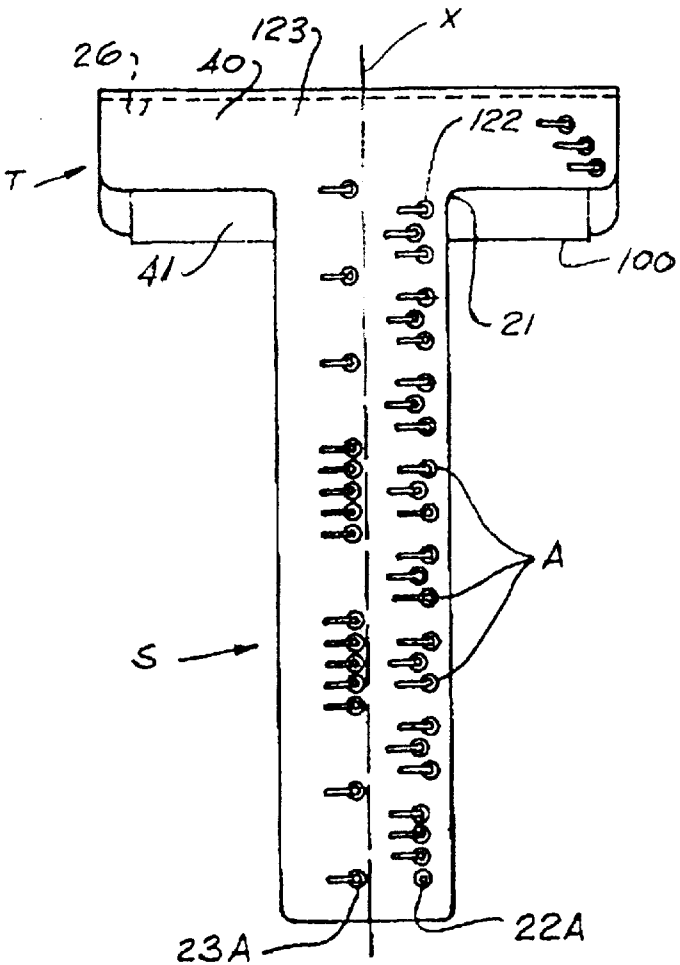
FIG. 2 is a top planar view of the guide showing the combined conical and linear guide apertures along the stem.

In the preferred embodiment, the U-shaped channel C incorporates interior tapered leading edge portions 33 and 34 at each end of the U-shaped channel C to facilitate smooth motion over the drywall sheet D where the U-shaped channel C comes into contact with the drywall sheet edge 27 at point 26. Also in the preferred embodiment, the U-shaped channel 20 is sufficiently wide to slidably accept drywall sheets in a variety of standard widths, and the axial relationship of the stem S extending therefrom is perpendicular to the longitudinal axis line a-b of the guide top T. The linear 23 and conical 22 guide apertures A formed through stem S are incrementally positioned in both metric and English measurement divisions from the guide edge longitudinal axis 26 located along the interior of the U-shaped channel C. Longitudinal axis 26 is shown in FIGS. 2–4. The incrementally positioned or spaced guide apertures A allow the user to mark or score a predetermined amount of material from the edge of the drywall sheet D without the use of a separate measuring device such as a tape measure or ruler. The length of stem S, as well as the number of apertures A, can be whatever length or number respectively as desired by the user.

Figure 8:
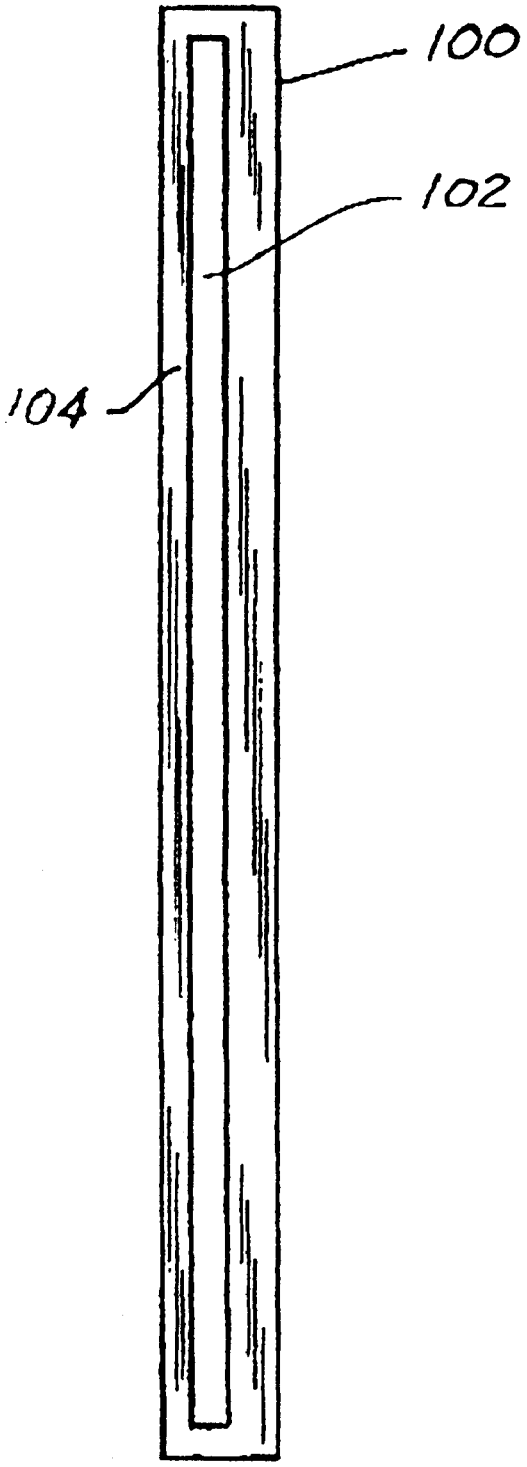
FIG. 8 is a view from line 8—8 of FIG. 3.

Referring back to FIG. 3, it may be seen that a sleeve 100 may be provided to fit over lower section 41 to adjust the thickness of section 41 to accommodate drywall sheets of varying thickness. Accordingly, as shown in FIG. 8, the sleeve 100 will have a passageway or opening 102 for engaging the lower section 41 and a wall 104 having a predetermined thickness sufficient to accommodate a chosen piece of drywall having a known thickness in the gap left between section 40 and wall 104.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An apparatus for guiding a cutting and marking device across a surface of a sheet of stock planar material having opposed planar side surfaces and a guiding marginal edge surface joining each of said planar side surfaces, the apparatus comprising a single-piece unitary construction and being freely slidable with respect to said marginal edge surface, said construction including:

a substantially flat, elongated stem section having a proximal end and a distal end;

said proximal end of said stem section comprising a substantially flat upper section formed integrally with and extending laterally in opposed directions relative to said stem section, a substantially flat midsection formed integrally with said upper section and extending perpendicularly relative thererto, said midsection having spaced apart upper and lower longitudinal edges extending substantially lengthwise relative to said upper section, and a substantially flat lower section formed integrally with said midsection and extending from the lower edge of said midsection and in the same lateral direction as said upper section; and a plurality of guide apertures being formed in said stem section.

2. The guide apparatus of claim 1 wherein said upper section, said lower section, and said mid section have interiorly tapered leading edge portions.

3. The guide apparatus of claim 1 wherein said guide apertures are incrementally spaced along the length of said stem.

4. The guide apparatus of claim 1 wherein said guide apertures comprise a conical formation in a portion of said stem.

5. The guide apparatus of claim 1 wherein said guide apertures comprise a slit formation in said stem.

* * * * *